United States Patent [19]

Enright et al.

[11] Patent Number: 4,522,784

[45] Date of Patent: Jun. 11, 1985

[54] CASTING METALS

[75] Inventors: Philip G. Enright, Hook Norton; Ian R. Hughes, Banbury; Richard M. Jordan, Hook Norton, all of England

[73] Assignee: Alcan International Limited, Montreal, Canada

[21] Appl. No.: 489,094

[22] Filed: Apr. 27, 1983

[30] Foreign Application Priority Data

May 4, 1982 [GB] United Kingdom ..... 8212837

[51] Int. Cl.[3] ..... C22C 1/00; C22C 32/00

[52] U.S. Cl. ..... 420/590; 75/10 R; 75/68 R; 164/473; 148/411; 148/415; 148/416; 148/417

[58] Field of Search ..... 420/590; 75/10 R, 68 R; 148/411, 415–418; 164/473, 55.1, 57.1, 58.1

[56] References Cited

U.S. PATENT DOCUMENTS

| | | | |
|---|---|---|---|
| 2,224,303 | 12/1940 | Junghaus . | |
| 2,225,414 | 12/1940 | Junghaus . | |
| 2,305,477 | 12/1942 | Junghaus . | |
| 3,194,656 | 7/1965 | Vordahl | 420/590 |
| 4,080,200 | 3/1978 | Sheridan | 75/135 |
| 4,147,533 | 4/1979 | Flinn et al. | 420/590 |
| 4,248,630 | 2/1981 | Balmuth | 420/590 |

*Primary Examiner*—Peter K. Skiff
*Assistant Examiner*—Christopher W. Brody
*Attorney, Agent, or Firm*—Cooper, Dunham, Clark, Griffin & Moran

[57] ABSTRACT

In the production of alloys, particularly Al alloys, by a continuous casting process a supplementary alloy stream is continuously fed into a main metal stream running to the casting mould. The supplementary alloy stream preferably amounts to 1–20% of the main metal stream and has a liquidus temperature above the temperature of the main metal stream so that on contact with the main metal stream, intermetallic phases are precipitated very rapidly as a result of the high chill rates.

This mode of casting reduces the risk of coarse primary particles when casting alloys of high alloying element content. The supplementary alloy stream need not be based on the same metal as the main metal stream. The method is considered suitable for the addition of various metals, such as Zr, Mn, Cu, Fe, to aluminium and aluminium alloys to overcome a variety of difficulties and to produce alloy products of improved properties.

18 Claims, 5 Drawing Figures

CASTING METALS

The present invention relates to casting metals and in particular to a method of casting metals for the purpose of promoting the formation of finely dispersed solid particles therein during the casting operation.

It is already known in British Pat. No. 1431895 to produce fine dispersions of intermetallic compounds in alloys, having a high content of alloying constituents, by methods involving spraying the molten metal in the form of highly undercooled droplets onto a substrate so that the metal undergoes chilling at a very high rate on impact. Such method results in solidified droplets, containing finely dispersed intermetallics or alloying constituents retained in supersaturated solid solution. The droplets then require compaction into solidified strip by a rolling operation. Such a procedure is however of limited practical importance for the production of alloys in bulk because of the practical difficulties involved in spraying, collecting the droplets in large quantities and overcoming difficulties resulting from the presence of surface oxide films on the sprayed droplets in subsequent processing.

It has recently been proposed in U.S. Pat. No. 4,278,622 to mix streams of molten metal under turbulent conditions in a mixing chamber in approximately equal quantities before casting into a mould. It is an essential feature of that process that the two liquid streams should impinge on each other under high energy conditions so as to establish a multiplicity of small eddies which mix with each other in the mixing chamber, so that the microstructure of the resultant solidified alloy is essentially due to the conditions of mixing of the original alloy streams.

In the method of the present invention described below the formation and distribution of intermetallics in the alloys is essentially due to the rapid chilling of one molten metal alloy stream by a second larger and cooler stream, resulting in a very rapid precipitation of intermetallics within the first (and minor) stream by reason of the high chill rate and temperature reduction of the first metal stream by the second metal stream.

The formation of dispersed solid intermetallic particles in a base metal matrix by a novel route finds utility in a variety of directions. It may result in the production of essentially known products more conveniently or with improved properties. Alternatively it may result in a commercially viable route for the production of products which could previously only be produced by commercially nonviable routes or may allow the production of essentially new alloys, both in terms of microstructure or composition.

The present invention relies upon the high thermal conductivity of molten metals and employs molten metal to act as a coolant for rapid chilling of a molten alloy at a higher temperature so as to produce solidified intermetallic particles or droplets of selected phases within a metal matrix. By reason of the high heat transfer rate in the system any precipitated particles or phases may be of very fine size.

In one of its widest aspects the process of the present invention comprises mixing a minor proportion of a relatively hot molten alloy with a major proportion of a relatively cool molten metal which is at a temperature below the liquidus temperature of the relatively hot molten alloy to precipitate precipitatable intermetallic particles or selected phases from said relatively hot molten alloy by contact with said relatively cool metal, dispersing the hot alloy through the relatively cool metal and chilling the mixture to solidify the same in a time period selected such that total re-solution of precipitated intermetallic particles or phases is avoided.

Since the equilibrium liquidus of the high temperature alloy is higher than the temperature of the melt at the point of mixing, the alloy is instantaneously in an undercooled environment and begins to freeze along a solidification path and at a rate defined by the constitution of the alloy, the degree of undercooling experienced and the change of heat distribution in the mixing zone and the extraction of heat from the total system. Some mixing of the alloy with the relatively cool metal unavoidably occurs simultaneously with this initial freezing of the hot alloy and prior to the onset of bulk freezing of the melt. Growth, transformation or re-melting of some or all of the pre-solidified phases generated in the earliest stages of the quench may also occur. By controlling the constitution, quenching temperatures and mode of mixing, various proportions of the pre-solidified phases can be retained in the final microstructure.

In carrying out the mixing of the relatively hot alloy with the cooler metal the hot alloy may be brought into contact with the cooler metal under conditions of turbulent flow so as to maximise heat transfer and to promote the dispersion of the intermetallic particles or solidified phases into the bulk metal as rapidly as possible.

Where the dissolution kinetics of the intermetallic particles or phases are relatively rapid, it may be desired to bring the two metal streams into contact under conditions approximating to laminar flow conditions so as to maintain an extremely high temperature and solute gradient at the interface between the two metal streams and consequently the intermetallic particles are deposited in exceptionally fine form. The complete mixing of the two metal streams is delayed until just before total solidification. In that way the fine intermetallic particles are in contact with the molten bulk metal for a very short time interval after complete dispersion therein so that re-solution of the very fine intermetallic particles is minimised.

It is well known that for a free liquid jet impinging on a continuous body of liquid with which it is infinitely miscible the penetration of the jet into the liquid medium is dependent upon the jet velocity.

There are separate optimum velocities for laminar flow jets and turbulent flow jets to achieve maximum penetration without complete dispersal.

In the process of this invention the mode of jet breakup on impingement strongly influences heat and solute transfer from the hot alloy feed to the cooler alloy in the mixing zone and the rate of deposition of intermetallic phases out of the hot alloy in the earliest stages of the quench.

In order to minimise the premature dispersion of the fine intermetallic phases into the cooler molten metal it is desirable, to either maximise the jet penetration length, or to enhance globularisation of the hot molten alloy and maintain stratified flow as far as the point where full turbulent mixing occurs in the mould. It is possible to maximise the jet penetration length in either the laminar or turbulent flow mode by appropriate design of the mixing zone.

By employing conventional flow visualisation experiments the geometry of the launder and dip-tube system can be established to achieve maximum jet penetration for the hot alloy stream, dependent upon supply of the hot alloy under laminar flow or turbulent flow conditions. The design of the apparatus should be such as to avoid the formation of relatively static zones where the precipitated particles might be retained for prolonged residence times and thus undergo excessive re-solution or growth.

It is generally desirable to feed the hot metal alloy from a small melt held at a relatively high temperature in a holding furnace, preferably under inert atmosphere.

In some instances it may be convenient to melt a prefabricated composite of the desired composition into the bulk metal by means of an electric arc, plasma gun or similar means. However this is not a preferred route because of the danger of introducing excessive oxide.

Whatever method is employed for introducing the hot alloy into a relatively cool bulk metal, such as molten Al, the bulk metal may be held at a normal relatively low temperature close to its melting point.

The cooler body of molten metal, which forms the major part of the resulting mix, may be alloyed metal or unalloyed metal. The hot molten alloy is commonly based on the same metal as the base of the cooler molten metal or contains a substantial proportion of such base, so as to be readily miscible with the cooler metal.

In most instances the quantity of hot molten alloy introduced into the cooler molten metal is in an amount of 1–20% of the cooler body of molten metal, although in some instances it may form a slightly larger proportion, but in general the proportion of hot metal alloy is held as low as is practicable to avoid undue temperature rise of the mix. The hot molten alloy is usually fed continuously into a stream of the cooler metal, flowing to a continuous or semi-continuous casting machine and it is preferred that the temperature of the mix should not result in an appreciable increase in the time interval between feeding to the mould and total solidification as compared with conventional practice.

As already indicated the time period between the introduction of the hotter molten alloy and the total solidification of the molten metal is arranged to avoid total re-solution of the pre-solidified phases. In almost all cases therefore a hotter molten alloy stream is introduced into a main metal stream very close to its entrance into the casting mould or even within the mould itself to keep the time interval between contact of the two molten metal streams and total solidification of the melt as short as possible.

The present invention will be exemplified by reference to aluminium and aluminium alloys. However the procedure of the invention is applicable to the production of alloys of other metals, such as lead-based, tin-based, zinc-based, magnesium-based, copper-based, nickel-based and iron-based alloys.

In many instances the hotter molten alloy is a binary alloy. In the case of Al-based alloys, typically the liquidus temperature of the hotter molten alloy is 50°–550° C. above the temperature of the cooler molten metal (which may be either Al metal or an Al alloy) so as to achieve a rapid chilling of the hotter molten alloy at a rate of $10^2$–$10^4$° C./sec. while avoiding excessive heating of the main body of molten metal by uptake of heat from the hot molten alloy. In some cases therefore the main body of molten metal is held at a lower temperature (before contact with the hotter molten alloy) than it would be held before casting in conventional practice. It is in fact one of the advantages of the present invention that it permits the use of relatively low holding temperatures in the production of certain alloys which currently require a relatively high holding furnace temperature. By use of the technique of the present invention a relatively small body of high temperature alloy is employed to introduce at or near the casting mould the constituent or constituents which would otherwise necessitate the use of a high holding temperature for the bulk of the alloy.

The maintenance of a lower holding temperature reduces the heat requirements and also involves less metal loss and contamination through oxidation.

In carrying the present invention into practice for the production of aluminium and other non-ferrous metal alloys the metal, after introduction of the higher temperature alloy, may be solidified in a conventional manner, for example by the conventional D.C. (direct chill) casting process. In the case of iron-based alloys, the hot metal feed is conveniently fed into the casting mould of a conventional continuous steel caster.

In the production of Al alloys the process has the advantage that the initial deposition of very large numbers of fine intermetallics completely or largely obviates the formation of coarse primary particles in the course of solidification by normal casting techniques, because the numerous fine intermetallics form nucleii for further deposition of intermetallics.

The very rapid quench achieved by the introduction of the hotter alloy into the cooler metal can result in the formation of non-equilibrium or metastable phases which may be retained in the microstructure in finely divided form where the initial quench is followed quickly by full solidification of the metal. The solidified phases are commonly in the range of 1–20 μm.

The process can be applied to existing ingot casting equipment without fundamental change to ingot casting practice, other than the introduction of a minor proportion of relatively hot metal to the stream of metal flowing to the casting mould. It is applicable to production of both cylindrical extrusion ingots and rectangular rolling ingots and in certain cases can have marked effects on ingot cast-ability and surface finish of the cast product.

Alternatively the process of the invention may be especially adapted to the production of thin D.C. (below 10 cm thick) ingot or thin slab by casting a controlled stream of the mix (containing solidified phases) onto a moving water-cooled substrate or belt.

The invention provides in its various forms the means for obtaining, via direct-chill casting one or more of the following results:

1. Ultra fine as-cast grain sizes without the addition of conventional grain refiners.
2. Novel intermetallic distributions in the base metal, e.g. aluminium.
3. Novel dendrite morphology in alloys of established commercial compositions.
4. Solidified phases in alloys which would not normally give rise to such phases under D.C. casting conditions.

These presolidified particles are commonly in the range of 1–20 μm and may be in the form of agglomerates.

In its application to aluminium and aluminium alloys the hot feed alloy is typically a binary alloy melt, of which the liquidus has a relatively shallow slope in a temperature range of 900°–1100° C. and preferably a much steeper slope in the range of 700°–900° C., so that a molten Al alloy having a high proportion of the solute element may be formed without requiring a very high temperature, but from which a major proportion of the solute is precipitated as fine intermetallic particles when it is brought into contact with the cooler main bulk of aluminium or aluminium alloy. Thus with zirconium, which is desirably present in small amount in several known Al alloy compositions, it has proved possible to employ a hot feed alloy up to 15% Zr in some circumstances, although it is normally preferable to introduce Zr in an alloy containing 2–5% Zr.

In general the invention may be applied to aluminium employing a binary hot feed alloy of aluminium and a metal of groups IVA (Ti, Zr, Hf) VA, (V, Nb, Ta) VIA (Cr, Mo, W) or a transition metal such as Mn, Fe, Co, Ni, Cu or semi-metals, in particular Si or Ge.

The binary hot feed alloy can also be an alloy in which there is only a minor proportion of aluminium such as Cu (75–90)%-Al (25–10)%.

In other instances the hot feed alloy may be a ternary or higher alloy containing aluminium. For instance it may be a Cu-based alloy containing 10–25% Al and 1.5–5% Zr.

In the accompanying drawings there are diagrammatically illustrated various forms of apparatus for putting the invention into practice.

Figure 1:
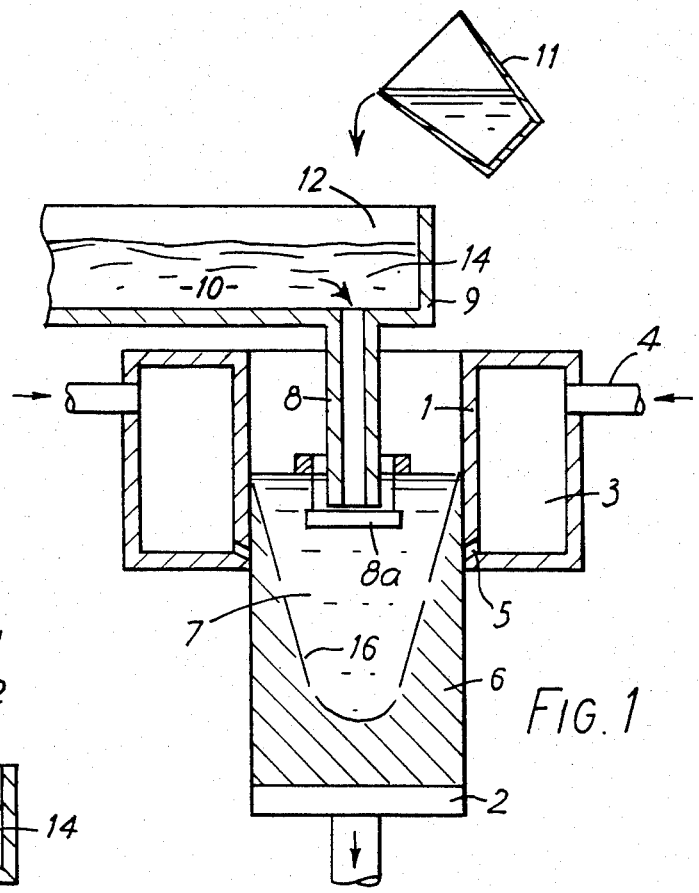
FIG. 1 is a diagrammatic vertical section of one form of continuous direct chill casting apparatus for performing the invention.

In FIG. 1 metal is cast in a conventional direct chill continuous casting system comprising an open-ended mould 1, which is initially closed by a stool 2, which may be lowered at a variable controlled velocity. The mould 1 is provided with an internal coolant chamber 3 through which a continuous stream of water passes from supply inlets 4 to exit through a slit 5 onto the solidified surface of the growing ingot 6 supported on the stool 2.

Metal is continually supplied to the molten metal pool 7 in the upper end of the ingot through a dip tube 8 and float valve 8*a*, which receives a stream of metal from a launder 9, leading from a holding furnace. In a conventional system of the type thus far described the level of molten metal in the mould 1 is maintained substantially constant by means of the float valve 8*a* which controls the outflow of metal from the dip tube 8. Thus the rate of metal flow through the dip tube 8 is, except at the start of the casting, controlled by the rate of lowering of the stool 2.

In the procedure of the invention the main metal stream 10, for example, aluminium or aluminium alloy at a temperature of 700° C., is contacted with a stream of an alloy having a liquidus at a temperature substantially above the temperature of the metal stream 10.

The stream of hot alloy is, in the system of FIG. 1, introduced into the main metal stream 10 from a crucible 11 at a controlled rate at a point 12 in the launder 9 close to the entry to the dip tube 8. Thus the end of the launder above the dip tube becomes a quenching zone 14, in which fine intermetallic particles or solidified phases are deposited within the relatively hot alloy. In the quenching zone the temperature of the metal stream 10 rises and the hot alloy is rapidly brought to approximately the same temperature by heat interchange. The main metal stream is moving at relatively low velocity in zone 14 and it is believed that there may be some degree of stratification in this zone. The metal flow in the dip tube is believed to remain in a stratified condition but becomes fully mixed under turbulent conditions in the region of the float valve 8*a*. In the region of the float valve 8*a*, because of the dilution consequent upon mixing with the bulk metal, the precipitated intermetallic particles or solidified phases are in some instances in only a metastable condition and are subject to re-solution into the molten metal. However they are rapidly incorporated into solidifying metal on reaching the solidification front 16 in the metal pool 7 and are thus brought into an essentially stable condition.

It will be seen that the float valve 8*a* forms a convenient means of dispersing the fine intermetallic particles through the molten metal mix very shortly before the metal reaches the solidification front. Where no float valve or similar instrumentality is provided to control the metal flow rate a stirrer or other agitating device would preferably be provided at the same location.

In the system of FIG. 1 reasonably accurate control may be exerted on the hot alloy temperature at the point of introduction into the main metal stream 10. It is less easy to tie in the rate of addition of hot alloy to the flow rate of the main metal stream 10, which is governed by the rate of lowering the stool 2.

Figure 2:
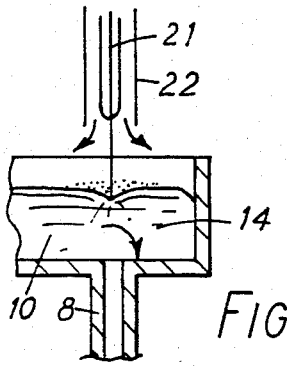
FIG. 2 is a diagrammatic vertical section of an alternative form of launder system for the apparatus of FIG. 1.

In the system of FIG. 2 (in which the same conventional D.C. casting mould is employed) the rate of addition of the hot alloy is more readily controllable than in the system of FIG. 1. In FIG. 2 a prefabricated rod or wire 21 of the desired hot alloy composition (but not necessarily in a fully alloyed homogeneous condition) is fed to a metal-insert gas welding gun 22 and falls as a continuous stream of metal onto the surface of the main metal stream 10. A degree of shielding of the surface of the molten metal stream 10 is provided by the stream of inert gas (usually argon) from the welding gun 22.

Figure 3:
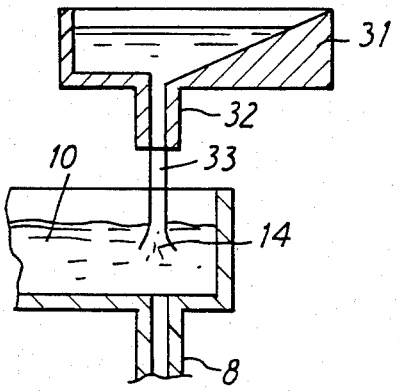
FIG. 3 is a diagrammatic vertical section of a further alternative form of launder system.

In the further alternative illustrated in FIG. 3 hot alloy from a crucible is fed into an intermediate launder 31, such as to maintain a substantially constant head of metal in the intermediate launder. The hot alloy then flows through a delivery tube 32 to fall into the metal stream 10 as a stream 33. The delivery tube 32 acts to meter the rate of flow of the hot alloy stream 33 this flow rate being dependent upon the viscosity of the hot alloy (consequently upon its temperature).

In the system illustrated in FIG. 3 it may be desired to introduce the hot alloy under laminar flow or less turbulent flow conditions into the molten metal stream 10. In such case the tube 32 may dip into the molten metal stream 10.

Figure 4:
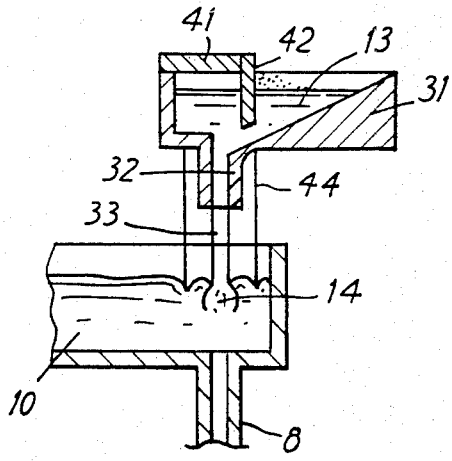
FIG. 4 is a diagrammatic vertical section of a still further alternative form of launder system.

The further system illustrated in FIG. 4 is designed to reduce the possibility of drag-in of oxide dross into the final cast ingot. In FIG. 4 the launder 31 is provided with a cover 41 and underflow weir 42, so that oxide dross collects on the surface of a side well space 43, from which it can be removed by skimming. The tube 32 is surrounded by a shield tube 44, which dips beneath the surface of the molten metal stream 10 and is maintained full of inert gas (argon) so as to avoid formation of oxide at the surface of the freely falling metal from the tube 32 and in the area of impact on the top of the metal stream 10.

We have found that the argon flow rate through the argon shroud tube 44 controls the formation of an oxide bag on the metal stream as it emerges from the delivery tube 32 which in turn affects the dimensional and directional stability of the stream. Metallographic examinations of castings made using this apparatus have shown that oxide stringers are often associated with non-dispersed droplets of the hot feed alloy. The argon flow rate is therefore desirably adjusted to a level where oxide formation is effectively suppressed.

Figure 5:
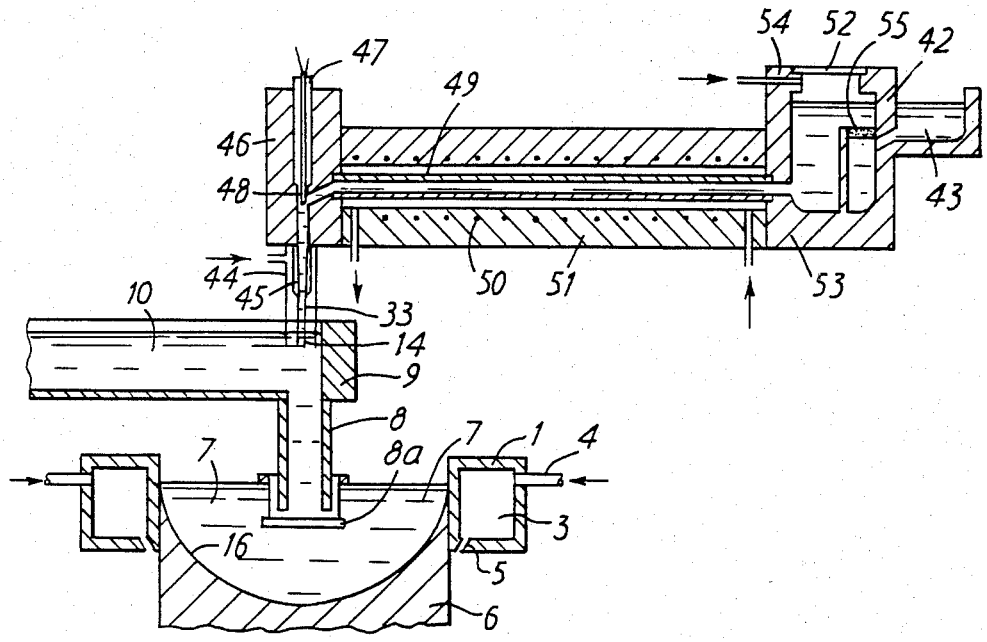
FIG. 5 is a diagrammatic section of a high temperature pipeline and nozzle arrangement for the supply of hot feed alloy to the casting mould, under inert gas cover.

FIG. 5 represents diagrammatically a further improved and preferred form of apparatus for carrying out the process of the invention.

In this apparatus the same reference numerals indicate the same elements as before.

The hot alloy is introduced into the sidewell space 43 and flows under the underflow weir 42 and upwardly through a filter 55 into a space within a tundish 53, provided with a cover 52. Argon is supplied through an inlet 54 and a slow inward stream of argon is maintained so that there is virtually no growth of oxide on the hot alloy in the tundish. The alloy is conveyed from the tundish through a ceramic transport pipe 49 surrounded by a flow conduit **49*a* for a stream of protective argon gas and heat is supplied as required to the hot alloy flowing through the transport pipe 49 by means of an electric heating coil 50. The temperature of the hot alloy is continuously measured by a thermocouple 48 and the supply of heat by coil 50 is adjusted to maintain a desired temperature at the location of thermocouple 48. The metal from the transport pipe 49 is transported via nozzle box 46 to a nozzle 45 located within a shield 44 within which an argon atmosphere is maintained. The nozzle 45 is detachable from the nozzle box 46** and different designs of nozzle may be employed according to the flow rates and jet velocities required.

As an alternative to employing a nozzle which discharges a jet of hot alloy at a level above the surface of the main stream of the molten metal, the jet nozzle may be a thermally insulated nozzle which releases a jet of molten alloy beneath the surface of the molten metal stream. In such case care must be taken to avoid freezing of metal in the nozzle.

The process has so far been applied particularly to the production of aluminium alloys containing small proportions of zirconium by the addition of aluminium-zirconium alloy as the hot alloy feed. Many established alloy compositions call for the addition of small proportions of zirconium and it is believed that the addition of that element may be of assistance in reducing metallurgical problems incurred in the production of various aluminium alloys. The maximum content of Zr that can usefully be incorporated in aluminium alloy ingots, cast by normal techniques is of the order of 0.25–0.4% depending on the alloy and grain refinement technique. There are however indications that higher Zr contents could provide useful benefits. Heretofore the commercial production of Al alloys with high Zr contents by D.C. casting has been hampered either by a requirement for an undesirably high casting temperature and/or solidification rates not readily attainable in commercial casting machines. The present invention allows the incorporation of a substantially increased quantity of Zr into the final alloy composition.

In various unpublished studies we have found that the incorporation of a small proportion of Zr may have benefits in the following fields:

(i) Reduction in the incidence of hot cracking (solidification cracking) during casting of alloys in the 7000 series.

(ii) Reduction in the softening of Al-Mn alloys when subjected to high temperature for prolonged periods.

(iii) Suppression of the growth of coarse primary particles in the casting of Al-Fe-Mn eutectic alloys and near-eutectic alloys.

At least some improvements in these three areas can also be achieved by addition of other transition elements, such as vanadium and molybdenum, in place of or in addition to Zr.

It is well known in the production of aluminium alloys to add small quantities of Al-Ti-B alloys (TiBor) to act as a grain refiner to hold down the grain size of the cast metal. The alloy contains particles which are very finely divided and act as nucleii for the growth of Al grains during solidification and thus suppress the growth of large grains. The addition of Al-Ti-B to alloys containing Zr in some instances is, however, ineffective.

In the development of the present invention it has been found that a molten Al-Zr alloy introduced into a molten Al or Al-alloy stream at a temperature below the Al-Zr alloy liquidus temperature acts as a very efficient grain refiner for aluminium (better than Al-Ti-B), when Zr is present in amounts as low as 0.05%, but more preferably in amounts in the range of 0.15–0.25%. Where the final Zr level is to be of this order, the hot Al alloy feed to the main Al or Al-alloy stream has a Zr content of the order of 1–15%, preferably 2–5%.

EXAMPLE 1

A series of 300 mm × 125 mm ingots of Al-Zn-Mg-Cu alloys was D.C. cast with the grain refinement method listed in Table 1. The HMF (hot metal feed) conditions (where employed for grain refinement) are given in Table 2. All of these alloys were prepared by feeding molten Al-Zr alloy from a high temperature holding crucible (at the temperatures indicated) employing the apparatus of FIGS. 1, 3 or 4.

Selected ingots were homogenized, rolled, solution heat-treated and aged and mechanical property data obtained. Each alloy was tested in both the longitudinal (LT) and long transverse (TC) orientation with respect to the rolling direction. Data obtained from 12.7 mm thick plate is recorded in Table 3.

It can be seen from the tables that the HMF techique has a significant grain refinement effect, particularly in the A composition alloys, having lower solute content. For example, comparing ingots 351 and C313A, the grain size is reduced from 129 μm to 60 μm. Ingot C350 of nominally the same composition (but without Zr), grain-refined by injection of TiBor rod, has a grain size of 140 μm.

For the higher solute alloys (B type), increasing the Zr content in the absence of Ti, increases the intrinsic grain refinement. The well known poisoning effect of Zr on TiBor grain refining can also be seen from Table 1. Grain sizes for the hot metal fed ingots are generally better than those obtained by TiBor in the absence of Zr, and considerably better than TiBor refinement in the alloys containing Zr. Also shown in Table 1 is one ingot containing an excessive amount of TiBor in which the grain size was below 100 μm.

The HMF conditions for each of the alloys are given in Table 2.

In addition to the grain refinement improvements resulting from HMF there is an enhanced resistance to "hairline hot cracking" during ingot solidification. the conventionally cast equivalents. Indeed, HMF material of the dilute type A composition compares quite favourably with material conventionally cast in type B (higher solute content) composition. Elongations are similarly improved.

TABLE 1

Grain Size and Hot Cracking Data for Alloys under D.C. Casting Conditions.

| Composition | Ingot No. | Grain Refinement method | Ti Content | Zr Content | Hot Cracking Condition* | Grain Size (μm) |
|---|---|---|---|---|---|---|
| A | C 350 | Ti Bor | 0.01 | — | U.C | 140 |
| A | C 351 | Intrinsic | — | 0.21 | U.C | 129 |
| A | C 313A | HMF+ | — | 0.21 | U.C | 60 |
| A | C 314 | HMF+ | — | 0.24 | U.C | 30 |
| B | C 313B | Intrinsic | — | — | C | >405 |
| B | C 152A | Intrinsic | — | 0.1 | C | 240 |
| B | C 294C | Intrinsic | — | 0.2 | U.C | 180 |
| B | MC | Ti Bor | 0.01 | — | U.C | 130 |
| B | C 153A | Ti Bor | 0.01 | 0.1 | C | 225 |
| B | C 291 | Ti Bor | 0.01 | 0.14 | C | 200 |
| B | C 596 | HMF+ | — | 0.15 | U.C | 100 (min) |
| B | C 597 | HMF+ | — | 0.14 | U.C | 100 (min) |
| B | C 654 | HMF+ | — | 0.14 | U.C | 150 |
| B | C 487 | HMF+ | — | 0.24 | U.C | 130 |
| B | C 612 | HMF+ | — | 0.2 | U.C | — |
| B | C 651 | HMF+ | — | 0.19 | U.C | 220 |
| B | C 661 | HMF+ | — | 0.21 | U.C | 140 |
| B | C 786 | Ti Bor to excess | 0.1 | — | U.C | <100 |

A = 4.7-5.0% Zn, 1.6-1.8% Mg, 1.4-1.6% Cu Rem Al + Grain Refiners
B = 5.9-6.5% Zn, 2.2-2.6% Mg, 1.5-2.2% Cu Rem Al + Grain Refiners
*C—cracked/U.C—uncracked
Intrinsic = no deliberate grain refinement treatment
HMF = grain refined by Zr in hot metal feed alloy, according to the invention
+see Table 2 for HMF conditions

TABLE 2

HOT METAL FEEDING CONDITIONS (D.C. INGOT) FOR TABLE 1.

| Composition | Ingot No. | Main Alloy Temp (°C.) | HMF Composition (% Zr) | HMF Temp (°C.) | Final Zr Content (% Zr) | Grain size (μm) |
|---|---|---|---|---|---|---|
| A | C 313A | 670 | 1.0 | 1100 | 0.25 | 60 |
| A | C 314 | 713 | 2.0 | 1100 | 0.25 | 30 |
| B | C 596 | 690 | 2.5 | 1000 | 0.15 | 100 |
| B | C 597 | 680 | 1.9 | 1010 | 0.14 | 100 |
| B | C 654 | 666 | 1.5 | 967 | 0.14 | 150 |
| B | C 487 | 790 | 1.0 | 1060 | 0.24 | 130 |
| B | C 612 | 668 | 1.0 | 1000 | 0.20 | N/D |
| B | C 651 | 672 | 1.5 | 971 | 0.19 | 220 |
| B | C 661 | 670 | 1.8 | 1025 | 0.21 | 140 |

(N/D—not determined)

Table 1 indicates that B type alloys, which are Zr-containing, are likely to crack when TiBor grain refiner is added, but show no cracking tendency when grain refined by hot metal feed with Al-Zr alloy.

From Table 3, comparison of the strength data shows considerable improvement in the HMF materials over

TABLE 3

TENSILE AND FRACTURE TOUGHNESS DATA (DC INGOT ROLLED TO PLATE)

| Composition Range | Ingot No. | G. Refinement method | Orientation of plate | 0.2% Proof MPa | UTS (MPA) | Elong. (%) | KQ ($MNm^{-3/2}$) |
|---|---|---|---|---|---|---|---|
| A | C 351 | — | LT | 431 | 485 | 14.5 | 43.5 |
| | | | TL | 409 | 463 | 13.7 | 41.46 |
| A | C 350 | Ti-Bor | LT | 409 | 462 | 14.5 | 46.9 |
| | | | TL | 405 | 453 | 11.6 | 39.7 |
| A | C 313A | HMF | LT | 455 | 518 | 15.5 | 42.9 |
| | | | TL | 429 | 496 | 15.2 | 31.0 |
| A | C 314 | HMF | LT | 460 | 519 | 16.7 | 37.2 |
| | | | TL | 451 | 508 | 15.5 | 27.0 |
| B | C 313B | — | LT | 481 | 528 | 11.0 | 42.25 |
| | | | TL | 478 | 525 | 10.0 | 35.23 |
| B | C 294C | — | LT | 483 | 541 | 14.0 | 38.1 |
| | | | TL | 478 | 535 | 12.4 | 33.1 |
| B | C 291 | TiBor | LT | 494 | 559 | 14.3 | 34.2 |
| | | | TL | 479 | 539 | 13.2 | 28.3 |

EXAMPLE 2

In another series of experiments the main metal stream was commercial purity aluminium with no alloying additions made to it.

The metal temperature in the launder was about 710° C. and Al-1% Zr and Al-2% Zr was supplied to it at a temperature of about 980° C. in an amount to provide a Zr content in the range 0.15–0.20%.

The melt was then cast in a conventional D.C. casting 8"×28" (203 mm×711 mm) mould as illustrated in FIG. 1. It should be noted that no conventional Al-Ti-B grain refiner alloy was added. The cast ingots had a grain size of approximately 100 μm.

The process of the present invention is an in situ alloying technique (alloying in the vicinity of the casting mould) which can be used to overcome the thermodynamic and kinetic constraints normally imposed on a metallurgical system. In effect it produces microcomposite structures, or transient microstructures which exist in metastable equilibrium long enough to influence the final structure and properties of the product.

In addition to the foregoing examples the HMF process of the invention may be used to overcome problems associated with surface crusting, primary intermetallic formation, oxide "stickiness" or cracking in the production of conventional alloys such as the high Al-Mn alloys, in which Mn is present in amounts up to 1.5%.

It is well known that there are difficulties in the production of such alloys because of the slow rate of dissolution of manganese in aluminium at normal holding temperatures of 760°–800° C. In the application of the present invention to the problem of producing Al alloys containing 1.5% Mn or more, a small quantity of an Al alloy containing 10% Mn or more at a high temperature, e.g. 1000° C., is injected into a stream of commercial purity aluminium or Al alloy flowing to a casting mould at a normal casting temperature in the region of 710° C. This procedure avoids the difficulties associated with the formation of coarse manganese aluminides Mn $Al_4$ or Mn $Al_6$. It requires the heating of only a relatively small body of metal to high temperature.

The HMF process offers the ability to move into new composition ranges for Al alloys, either by exploiting the grain refinement aspects and improved hot cracking response or by the addition of a hot feed alloy, which is not Al-based or an alloy in which a very significant proportion is formed by alloying additions. Extended 7000 series Al alloys may be produced by addition of 75–90% Cu-25-10% Al feed to a mainstream of Al-Zn-Mg alloy or alternatively the feed may contain other transition metals. The liquidus of the Cu-Al alloys in the above composition range lie between 900° C. and 1050° C. and the feed is preferably supplied at a temperature approximately 50° C. above the liquidus.

We have shown that by quenching copper based alloys into aluminium it is possible to retain presolidified copper rich intermetallic phases in a final microstructure which has an average composition on the aluminium rich side of the Cu-Al phase diagram. In laboratory experiments a stream of molten Cu-Al alloy was fed into a cylindrical bath of aluminium, from which heat was already being extracted and in which a solidification front had already been well established by means of controlled water cooling, to simulate feeding of hot molten alloy flowing to a continuous casting mould. Fine droplets of the copper-rich alloy formed in the earliest stages of mixing were able to exchange latent heat with the solid dendritic front in the Al bath and thereby freeze extremely quickly. Phases formed during this reaction were then frozen as quickly as possible into the residual liquid by maintaining the heat extraction from the system at a maximum. Qualitative analysis of the phases present revealed that, in addition to α-aluminium and α-$CuAl_2$ eutectic, there was a considerable volume fraction of copper rich intermetallic containing up to 80–90% copper. This phase was distributed mainly, at cell and grain boundaries, but also within the α-aluminium dendrite cells.

The advantage of this route in the production of wide freezing range alloy systems is that, by splitting the melt into parts, certain solutes (for example Cu in 7000 series aluminium alloys) are to a greater or lesser extent prevented from taking part in the normal microsegregational sequences occurring during solidification. In this way alloy freezing ranges and/or volume fraction of, for example, low melting point eutectics can be altered; this in turn can affect both castability and heat treatment response of the alloy system. For example in the casting of ultra-high strength Al alloys Cu is the major problem because it enhances hot cracking when allowed to combine with Zn and Mg to form a low melting point eutectic. By tying up the copper in a different form this will not happen and the freezing range of the alloy will be reduced and consequently there will be less cracking. Homogenisation heat treatment may be employed to transform these Cu-rich phases later.

In another further example the mainstream metal in the launder is a hypereutectic Al-Fe-Mn alloy containing, for example, 1.6% Fe and 0.6% Mn at a temperature of 700° C. Into this alloy a hot metal feed Al-Fe alloy, containing Fe, for example, 10% Fe was fed in amount to raise its liquidus to a temperature above 900° C. The exemplified Al-10% Fe alloy at a temperature of 950° C. was introduced in an amount of about 1 to 24 parts to raise the Fe content to 2% so as to raise the Fe+Mn content of the alloy to a hypereutectic level. Examination of the as-cast structure showed no large primary $FeMnAl_6$ or $FeAl_3$ particles. Instead additional $FeAl_6$ particles were distributed within the aluminium cells in a size comparable with the eutectic particles present in the bulk matrix.

The process of the invention produces novel alloys, either in the sense of being of conventional composition, but a different microstructure, or novel in the sense of being entirely different compositional systems, hitherto not made commercially by the D.C. process or other commercial casting process.

As an example of the application of the HMF, process to the production of known alloys with modified dendritic structures AA2024 alloy (3.8–4.9% Cu, 0.3–0.9% Mn, 1.2–1.8% Mg) was hot metal fed with Al-5% Zr at 1150° C. resulted in a novel dendrite and second-phase morphology. This alloy, when cast by D.C. casting as 178-mm diameter ingot and containing 0.4% Zr added in the melting furnace results in the formation of large plates of tetragonal $ZrAl_3$ in the as-cast alloy. Al-Zr alloys of other composition may be employed in amounts to yield 0.2–0.5% Zr in the final product.

The application here of the HMF process is to exploit the novel dendrite morphology and consequent second phase distribution in terms of, for example, heat treatability or hot deformation and re-crystallization behaviour.

Aluminium and its alloys are primarily low temperature materials and historically nearly all of the melting and casting plant technology is designed around a maximum working temperature of about 800° C. As the demand for more highly alloyed materials increases together with a growing interest in the greater temperature stability so the need for higher casting temperatures or alternative processing routes for aluminium alloys, increases.

As well as the problems associated with melting and holding, the comparatively low cooling rate obtained during direct chill casting of aluminium alloys places severe limitation on the compositions which can be cast without the formation of unwanted primary intermetallic compounds, coarse secondary constituent particles or coarse impurity phase particles particularly in large ingots. Processes which provide a much more rapid solidification rate, such as spray casting and splat cooling, and which have often been invoked as a means of inhibiting the nucleation and growth of intermetallic particles, have not as yet been found capable of producing large quantities of material in a readily usaable form either for production of extruded or rolled products.

The two-step solidification reaction in the HMF process of the invention enables elements such as Zr, Nb, W, Cr, Mo and other high melting point metals to be combined with Al without the above problems. Such elements form very stable aluminides which do not readily redissolve in molten Al.

The size of intermetallic particles can be varied by changing the initial droplet size, controlling the addition composition and temperature and the residence time of the intermetallic particles in liquid aluminium before they are incorporated into solid.

EXAMPLE 3

From laboratory scale tests employing a permanent mould and simulating the HMF process it has been shown that considerable grain refinement is achieved by hot metal additions of Al-Cr, Al-Ti, Al-Zr, Al-Nb and Al-Fe, to a high purity aluminium base melt. The experiments were carried out by simply pouring the hot metal from a small crucible into a second larger crucible and then immediately discharging the mixture through a bottom hole into a Cu chill mould, 2.5 cm×10 cm×15 cm in size. A selection of the results is given in Table 4.

It can be seen that all hot metal fed alloys have a grain size finer than their conventionally cast counterparts and all are as fine or finer than a good quality TiBor refiner. An high purity Al (not grain refined) is also recorded for comparison in section 2.

It is estimated that the quench rates obtained in the batch apparatus are of the order of $10^{3}$° C./sec., similar to those obtained in continuous casting by the apparatus of FIGS. 1–5.

Results obtained from separate residence time tests have indicated that presolidified Zr-$Al_3$ particles remain active as nuclei for about 2 minutes, which is adequate for the casting of large ingots by the D.C. casting process, employing the HMF process of the invention.

EXAMPLE 4

Using the laboratory apparatus described in Example 3 we have prepared a series of binary Al alloys as setout in Table 5. These results indicate the practicability of adding the indicated alloying constituents by the HMF process through at least a part of the indicated composition ranges.

We have found it possible to produce novel distributions of intermetallic particles and in some cases regions of enhanced supersaturation in the aluminium matrix. The overall uniformity of product is determined by the efficiency of droplet break-up after the initial quench has occurred. The size of intermetallic particles can be varied by changing the initial droplet size (cooling rate) and controlling the composition, temperature and residence times. Using the range of feedstock compositions indicated in the table and for residence times varying between 2 and 30 seconds (interval between hot alloy feed introduction and solidification) we have obtained inter-metallic particles in three size ranges, depending on alloying element.

It is possible to rate the elements in Table 5 in terms of a tendency to form particles easily, or a tendency to form supersaturated solid solution easily. The order is Nb, Mo, Zr, Cr, W.

For those elements which tend to form particles more readily (Nb, Mo, (Zr)) it is also possible to form a fine dispersion of aluminides at lower compositions than in conventional chill casting.

TABLE 4

| Base | Bath Temp (°C.) | Hot Alloy Feed | Feed Temp (°C.) | Final Composition wt % | Grain size | Comments |
|---|---|---|---|---|---|---|
| Section 1. | | | | | | |
| Al—0.1% Zr | 700 | — | — | 0.10 | Columnar 5000μ × 1000μ, Equiaxed 200μ to 1500μ. | Normally cast |
| Al—0.15% Zr | 700 | — | — | 0.13 | Columnar 10000μ × 1000μ Equiaxed ≈ 500μ. | |
| Al—0.20% Zr | 700 | — | — | 0.20 | Columnar 5000μ × 1000μ, Equiaxed 200μ to 500μ. | |
| Al | 670 | Al—3% Zr | 1200 | 0.10 | Columnar 5000μ × 400μ, Equiaxed 200μ to 300μ. | Effect of bath temperature |
| Al | 700 | Al—3% Zr | 1200 | 0.10 | Columnar 5000μ × 700μ, Equiaxed ≈ 400μ. | |
| Al | 720 | Al—3% Zr | 1200 | 0.07 | Columnar 10000μ × 1000μ Equiaxed ≈ 2000μ | |
| Al | 700 | Al—1% Zr | 950 | 0.09 | Columnar 10000μ × 1000μ | Variation of HMF Composition |
| Al | 700 | Al—3% Zr | 1200 | 0.10 | Columnar 5000μ × 700μ Equiaxed ≈ 400μ | |
| Al | 700 | Al—5.3% Zr | 1200 | 0.09 | Equiaxed 350μ to 450μ | |
| Al | 700 | Al—7.5% Zr | 1200 | 0.08 | Equiaxed 200μ to 500μ | |
| Al | 700 | Al—10% Zr | 1250 | 0.10 | Equiaxed 200μ to 250μ | |
| Al | 700 | Al—16.4% Zr | 1300 | 0.09 | Equiaxed 150μ to 250μ | |
| Al | 670 | Al—5.3% | 1200 | 0.05 | Equiaxed 150μ to 200μ | Different final Zr |
| Al | 670 | Al—5.3% | 1200 | 0.15 | Equiaxed 50μ to 100μ | |

TABLE 4-continued

| Base | Bath Temp (°C.) | Hot Alloy Feed | Feed Temp (°C.) | Final Composition wt % | Grain size | Comments |
|---|---|---|---|---|---|---|
| | | | | | | levels |
| Section 2. | | | | | | |
| Al | 700 | — | — | — | Columnar 10000μ × 1000 μm Equiaxed 400μ–2000 μm | |
| Al | 700 | (TiBor Addition) | | Al—0.01 Ti | 150μ | |
| Al | 670 | Al-4% Cr | 1000 | Al—0.42% Cr | 100–500 μm | |
| Al—0.4% Cr | 700 | — | — | Al—0.4% Cr | 2000 μm (max) | |
| Al | 670 | Al—3.3% Fe | 750 | Al—0.35% Fe | 50–100 μm | |
| Al—0.35% Fe | 690 | — | — | Al—0.35% Fe | 300 μm (max) | |
| Al | 670 | Al—1% Ti | 1000 | Al—0.09% Ti | 100 μm | |
| Al—0.1% Ti | 700 | — | — | Al—0.1% Ti | 150 μm | |
| Al | 700 | Al—2.8% Nb | 1300 | Al—0.11% Nb | 150 μm | |
| Al—0.085% Nb | 700 | — | — | Al—0.085% Nb | 150–500 μm | |

TABLE 5

| Base | Hot Alloy Composition (%) | Hot Alloy Temperature Range | Alloy Final Composition | Mixing Ratio |
|---|---|---|---|---|
| Al | 5–10% W | 950–1200° C. | 0.1–0.24% W | 25:1 to 80:1 |
| Al | 10% Cr | 950° C. | 0.15–0.75% Cr | 12:1 to 66:1 |
| Al | 2.8–5% Nb | 1225–1300° C. | 0.044–0.18% Nb | 18:1 to 70:1 |
| Al | 2–10% Mo | 1130, 1170, or 1200° C. | 0.089–0.49% Mo | 4:1 to 111:1 |
| Al | 1–16% Zr | 950° C. to 1300° C. | 0.05–0.4% Zr | 4.5:1 to 110:1 |

The invention is by no means confined to the use of a binary alloy as the hot metal feed alloy. For example, it may be a ternary or higher alloy from which it is desired to form special phases, or in which additional solute components are found to modify the formation of a desired intermetallic phase. For example, from laboratory chill castings, it has been shown that the presence of other solute such as Zn, Cu or Mg, modify, suppress or stabilise the formation of $ZrAl_3$ crystallites in Al-Zr alloys. It may therefore be desirable to add all or part of a third solute element via the hot metal feed alloy, depending on the desired $ZrAl_3$ distribution.

For example, ternary alloys have been produced in which the total alloying content has been added via the hot metal feed. In each case the distribution of $ZrAl_x$ has been found to be different to that obtained from using a simple binary Al-Zr feedstock. The alloys are summarized in Table 6.

TABLE 6

| Base | Temp °C. | Hot Alloy Feed % | Temp °C. | Final Nominal Composition |
|---|---|---|---|---|
| Al | 670 | Al—6Cu—3Zr | 1100 | Al—0.39Cu—0.2Zr |
| Al | 670 | Al—1.2Mg—3Zr | 1100 | Al—0.07Mg—0.19Zr |
| Al | 670 | Al—2.4Mg—1.8Zr | 1100 | Al—0.17Mg—0.12Zr |
| Al | 670 | Al—2.3Zn—3Zr | 1100 | Al—0.15Zn—0.2Zr |
| Al | 670 | Al—9Zn—1.95Zr | 1100 | Al—0.6Zn—0.13Zr |

A further example is in the production of 7000 series alloys where the $ZrAl_3$ distribution can be modified by the presence of Cu in the feedstock. It is desirable to limit growth of excess $ZrAl_3$ (equilibrium) crystallites but still maintain adequate grain refinement. This can be achieved using ternary hot alloy feeds in the range Al-39.5% Cu-3% Zr to Al-13% Cu-1% Zr, where at one extreme all the copper is added via the feed, and in the second only part of the copper.

In a further example in the production of 7000 series in which the final alloy contains both Zr and Cr, the Zr and Cr content of the alloy are incorporated in the hot feed alloy. In some instances it may be desirable to incorporate the chromium into a hot feed alloy also containing Cu, in addition to Zr.

Ternary (or higher order) hot feed alloys for addition to Al or Al alloys may be aluminium-based, or, where a large percentage of a third solute is required in the final alloy, or where a large volume fraction of special intermetallic phases is required, the hot alloy feed may only contain a minor proportion of aluminium and in some special cases may contain no aluminium at all.

For example, it has proved possible to produce Al-Cu-Zr alloys with extremely fine grain sizes using copper-rich feedstocks containing aluminium and zirconium using the present process with resultant grain sizes indicated in Table 7. Alloys of this type may be conventionally cast, but normally require very high casting temperatures. This technique offers the possibility of obtaining a fine, uniform grain size at considerably lower Zr content than is required by the conventional processing route.

TABLE 7

| Base | Temp. (°C.) | Feedstock (wt %) | Temp. (°C.) | Nominal Mixing Ratio | Final Composition (nominal) | Grain size |
|---|---|---|---|---|---|---|
| High Purity Al | 685 | Cu—25Al—1.6Zr | 1000 | 4:1 | Al—6.8Cu—0.4Zr | 40 |
| High Purity Al | 685 | Cu—25Al—0.8Zr | 900 | 4:1 | Al—8Cu—0.2Zr | 50 |
| Al—8Cu—0.5Zr | 730 | Conventionally cast | | | | 105 |
| Al—8Cu—0.25Zr | 700 | Conventionally cast | | | | 210 |

We claim:

1. A method of producing metal alloys which comprises mixing a minor proportion of a relatively hot molten alloy with a major proportion of a relatively cool molten metal which is at a temperature below the liquidus temperature of the relatively hot molten alloy to precipitate precipitatable intermetallic particles or selected phases from the relatively hot molten alloy by contact with said relatively cool metal, dispersing the hot alloy through the relatively cool metal and chilling the mixture to solidify the same in a selected time period such that total re-solution of precipitated particles or phases is avoided.

2. A method of producing metal alloys according to claim 1 in which a stream of the hot molten alloy is introduced as a relatively rapid moving jet into a relatively slow moving stream of the cooler molten metal at a first location and the combined stream is continuously solidified at a second closely adjacent location.

3. A method according to claim 2 in which the combined metal streams are subjected to turbulent mixing at a location between said first and second locations.

4. A method according to claim 3 in which the combined metal streams are turbulently mixed at a valve controlling the flow of molten metal into a continuous casting mould.

5. A method according to claim 2 in which the hot molten alloy issues as a jet stream from a nozzle located above the surface of the cooler molten metal stream and a protective shroud of inert gas is provided around the free falling jet stream.

6. A method according to claim 1 in which the hot molten alloy is supplied in an amount of 1–20% of the cooler molten metal.

7. A method according to claim 1 in which the hot molten alloy contains a significant proportion of the base metal of the cooler molten metal.

8. A method according to claim 7 in which the hot molten alloy is an aluminium-based alloy and the cooler molten metal is aluminium or an aluminium-based alloy.

9. A method according to claim 7 in which the hot molten alloy is an Al alloy containing at least one element selected from the group Mn, Fe, Co, Ni, Cu, Ti, Zr, Hf, V, Ta, Cr, Mo, Nb, W, Si, Ge.

10. A method according to claim 7 in which the hot molten alloy contains 1–15% Zr.

11. A method according to claim 7 in which the hot molten alloy contains 2–5% Zr.

12. A method according to claim 9 in which the hot molten alloy is a binary Al alloy.

13. A method according to claim 10 in which the hot molten alloy is introduced into the cooler molten metal as an Al-Zr binary alloy in an amount sufficient to yield 0.05–0.25% Zr in the final product.

14. A method according to claim 6 in which the hot molten alloy is an Al-Mn alloy containing at least 10% Mn and is introduced into a body of cooler molten Al-based metal in an amount to yield at least 1.5% Mn in the final product.

15. A method according to claim 6 in which the cooler body of molten alloy is a hypo-eutectic Al-Fe-Mn alloy and the hot molten alloy is an Al-Fe alloy having an Fe content sufficient to raise the liquidus temperature above 900° C. said hot alloy being added in an amount sufficient to raise the Fe content of the Al-Fe-Mn alloy to at least 2%.

16. A method according to claim 6 in which the relatively cool molten metal is an Al alloy containing 3.8–4.9% Cu, 0.3–0.9% Mn, 1.2–1.8% Mg and the hot metal alloy was an Al-1-75% Zr alloy, supplied in an amount to yield 0.2–0.5% Zr in the final product.

17. A method according to claim 6 in which the final product is an Al-Zn-Mg-Cu alloy and the hot metal alloy is a ternary Al alloy containing 13–39.5% Cu and 1–3% Zr and is supplied to a cooler body of molten metal containing all the Zn and Mg content of the final product, said cooler metal containing no or less than the full amount of Cu of the intended final product, the hot Al-Cu-Zr alloy being supplied in an amount sufficient to raise the Cu content to its intended final level.

18. A method according to claim 1 for making aluminium alloy in which the hot molten alloy is copper-based alloy containing 10–30% Al.

* * * * *